United States Patent [19]

Bijttebier

[11] 3,981,495

[45] Sept. 21, 1976

[54] PROCESS AND APPARATUS FOR SEPARATING SUPPLE SHEETS FROM A STACK

[76] Inventor: Gaspar A. H. Bijttebier, Grote Heerweg 64, B -8749 Beveren (Leie), Belgium

[22] Filed: Oct. 24, 1974

[21] Appl. No.: 517,626

[30] Foreign Application Priority Data

| | | |
|---|---|---|
| Oct. 26, 1973 | Belgium | 806540 |
| Oct. 26, 1973 | Belgium | 806541 |
| June 27, 1974 | Belgium | 816940 |

[52] U.S. Cl. ..... 271/18.3; 221/213

[51] Int. Cl.[2] ..... B65H 3/22

[58] Field of Search ..... 271/18.3, 19, 21, 22, 271/23, 18, 119, 120, 141; 294/61; 221/213, 214, 215, 216

[56] References Cited

UNITED STATES PATENTS

| | | | |
|---|---|---|---|
| 793,009 | 6/1905 | Miller | 271/18.3 |
| 3,386,763 | 6/1968 | Ottaway et al. | 271/18.3 X |
| 3,471,994 | 10/1969 | Cranston et al. | 271/19 X |
| 3,601,390 | 8/1971 | Morton | 271/18.3 |
| 3,625,506 | 12/1971 | Rovin | 271/18.3 |

*Primary Examiner*—Evon C. Blunk
*Assistant Examiner*—Bruce H. Stoner, Jr.
*Attorney, Agent, or Firm*—Shlesinger, Arkwright, Garvey and Dinsmore

[57] ABSTRACT

A process for separating one or more supple sheets from a stack includes the steps of compressing the stack at least in the vicinity of its opposite upper edges, simultaneously or subsequently introducing sharp projections in or near the edges in order to pick up the sheet or sheets, moving the opposite projections apart slightly in opposite directions to tighten or stretch the sheet or sheets and finally lifting the engaged and tightened sheet or sheets from the stack. Apparatus for performing this process comprises a pair of separating members movable vertically toward and away from the stack of sheets, the members including a surface adapted to compress the stack in the vicinity of opposite upper edges thereof. The members also include pricking members which are movable horizontally relative to the stack and engageable with a predetermined number of uppermost sheets therein.

9 Claims, 32 Drawing Figures

3
5
16
19
21
d

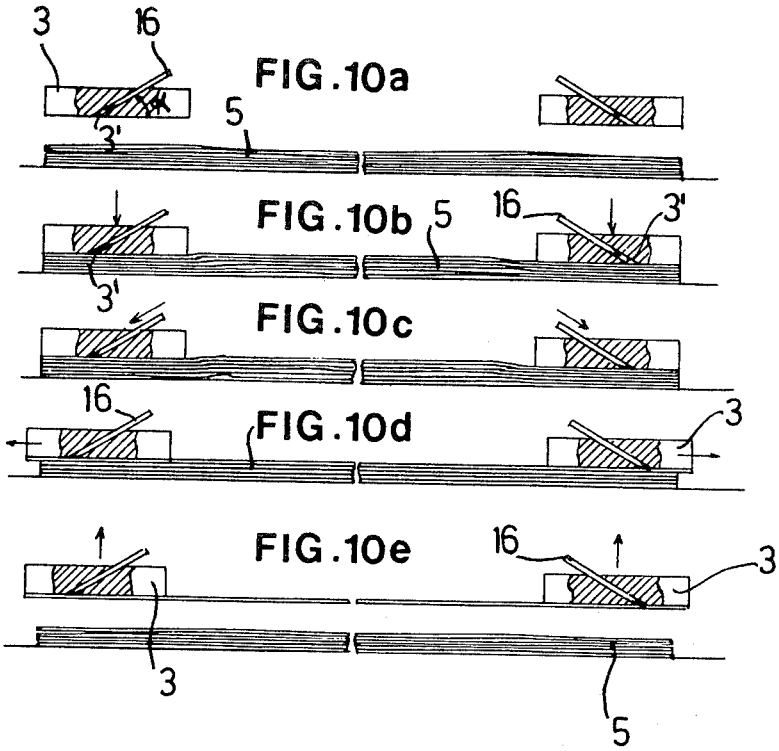
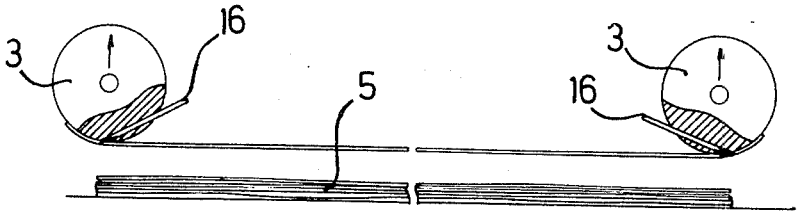
FIG.11
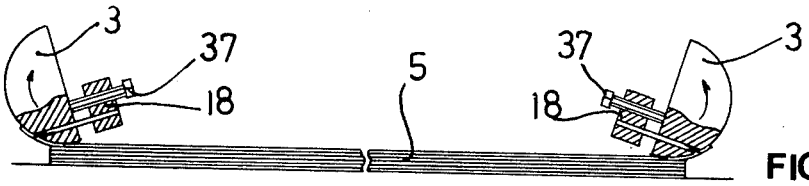
FIG.12
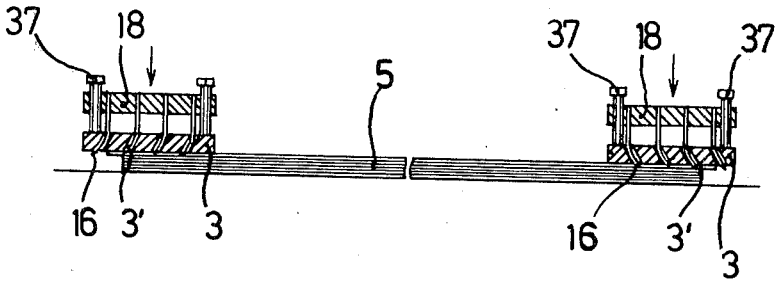
FIG.13

PROCESS AND APPARATUS FOR SEPARATING SUPPLE SHEETS FROM A STACK

This invention relates to a process and apparatus for separating one or more layers of supple material, such as textiles, felt, plastic or rubber foils, or synthetic leather from a stack.

Some industrial serial production processes involve the successive removal of one or a definite number of sheets, such as textiles, knitwear, felt, etc., from a stack of such sheets. One example of such a process can be found in the ready-made clothing industry where sheets have to be removed one by one from a stack of size cut textile sheets for further processing in stitching machines.

It is well known that, when separating said sheets from a stack, account often should be taken of the fact that many materials tend towards a certain natural adherence or hitching, which tendency, in the case of synthetic textile or synthetic leather sheets, is further strengthened by the build-up of electrostatic charges on the filters which are induced by, among other things, the cutting of the sheets. Moreover, cutting itself stimulates the mutual adherence of the stacked sheets, owing to the fact that the cut edges are more or less bent and catch on each other. The sheets also catch on each other owing to the unraveling of threads or fibers at the edges.

In order to separate such sheets from a stack, different solutions have heretofore been proposed.

A first solution consists in the use of adhesive tapes applied on the upper sheet which is to be picked up. However, in this manner it is neither possible to separate two or more sheets at the same time, if so desired, nor is one certain of the number of sheets removed. Consequently, it often occurs that due to accidental adherence or hitching, the next lower sheet is shifted at least at its edges so that the normal automatic removal is impeded.

Another known solution for removing such sheets consists in applying a number of open claw-shaped grips upon the surface of the sheet and then closing the grips with the sheet in between, which is thus removed. Also in this case, the number of layers removed can not be controlled and hitching frequently results in that the underlying sheets are shifted.

The same disadvantage is produced by another proposed solution whereby use is made of metal brushes or cards with curved teeth attached to pressure plates or pressure wheels, said teeth being locally pressed into the sheet to be removed in order to pick it up.

Also, when using separating devices with sucking action, the number of sheets removed can hardly be controlled, especially when said layers are, for example, light or coarsely woven.

It is an object of the present invention to obviate the imperfections of the existing separating devices and separating methods and to permit removal one or more sheets from a stack with maximum certainty. The invention particularly provides a universal apparatus for the automatic performance of the separating operation.

The process aspect of the invention mainly consists in compressing a stack of sheets, at least in the vicinity of two opposite upper edges of the stack, in order to substantially flatten at least locally the sheet or sheets to be removed, introducing needles, pins or similar sharp projections in the sheet near its edges, after which said projections are moved in opposite directions in order to tighten or stretch the pricked sheet or sheets to some extent, and finally lifting up the thus tightened sheet or sheets. It is precisely due to this tightening action that the pricked sheet or sheets are forced to fully detach themselves from the underlying sheet of the stack so that any hitching is prevented.

The sequence of compressing and picking up is not strict: it is possible to first compress the stack and next to pick up the sheet or sheets. It is also possible to compress and to pick up simultaneously or even to have a simultaneous compressing and picking up step preceded by a preliminary compressing step. The different process steps therefore can be controlled jointly or separately.

A very adequate separating process consists in first compressing locally a stack of sheets in the vicinity of two opposed edges thereof, in order to at least flatten the sheet or sheets to be picked up, next introducing at least one needle or pin end near each of said edges into the sheet or sheets to be picked up, successively slightly releasing the applied pressure almost simultaneously with slightly lifting the pricked layer, and next tightening the sheet or sheets to be picked up by slightly forcing apart the opposed pricked sheet edges by means of the needle points whereafter the sheet or sheets thus separated from the stack are lifted.

Moreover, it has proved advantageous to apply an additional linear pressure in the direct vicinity of the needle or pin points when the latter are introduced into the sheet or sheets.

The features of the invention will become apparent from the following descriptions of some preferred embodiments of the invention, given by way of example, whereby reference is made to the accompanying drawings, in which:

FIGS. 1*a* to 1*d* are schematic views of four characteristic steps of the process according to the invention, whereby simple separating devices are used;

FIGS. 2 to 8 are views of a number of other suitable separating devices;

FIGS. 9*a* to 9*c* are views of variant process steps whereby a sheet picked up from a stack is deposited upon the top of another stack. From the latter stack at least two layers are then picked up.

FIGS. 10*a* to 10*e* are views of still another embodiment with separating elements whereby compressing and picking up are separately controlled.

FIGS. 11 to 13 are views of a number of similar suitable separating devices functioning in accordance with the principle shown in FIG. 10.

Figure 17:
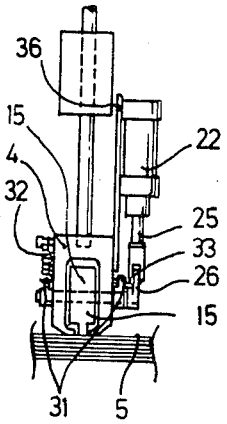
Figure 16A:
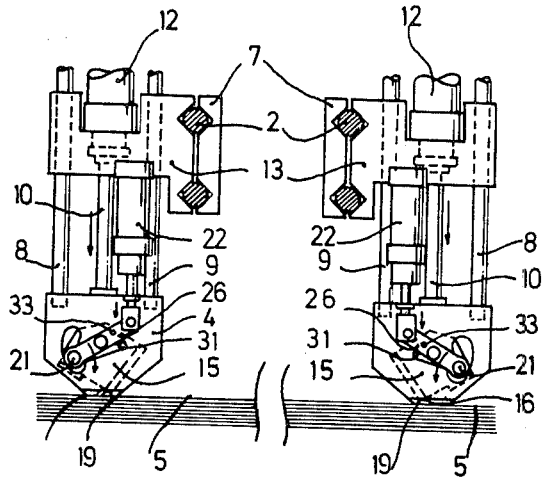
Figure 18:
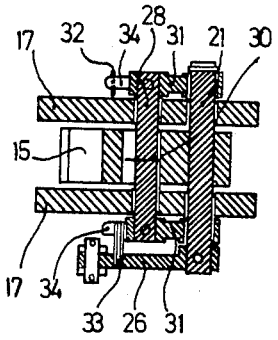
Figure 16B:
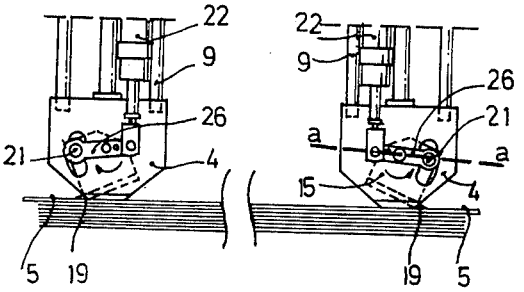
Figure 16C:
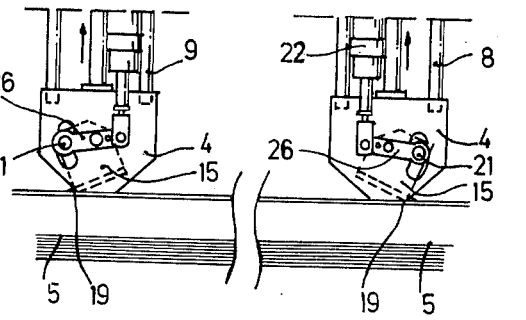

FIGS. 16*a*, 16*b*, and 16*c* are schematic views of some working positions of the pick-up head with pricking element, both being parts of the above mentioned separating element: successively the compressing position (FIG. 16*a*); the pricking position (FIG. 16*b*); and finally the tightening position whereby the sheet is stretched and lifted;

FIG. 17 is a side view of the separating element of FIG. 16;

FIG. 18 is a cross-sectional view of the separating element on the line a—a of FIG. 16*b;*

Figure 19:
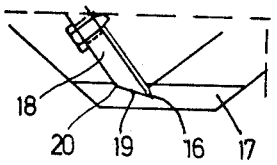

FIG. 19 is an enlarged detailed view of the pricking element of the separating element of FIG. 16.

Referring to FIGS. 1*a* to 1*d*, four important steps of the process as set forth in the invention and whereby separating elements 3 in their simplest embodiment are used will be described. The separating elements 3 comprise a cubical or beam-shaped pressing element which is placed in the vicinity of two opposite upper edges of a stack of supple sheets 5.

The proper pressing surface i.e. the bottom surface 19 of each separating element is provided with at least one downwardly projecting needle or pin 16, whereby the distance *l* from the free end of such a projection 16 to said bottom surface 19 of separating element 3 (hereinafter called "insertion length *l*") is equal to or slightly less than the thickness *d* of the sheets to be lifted.

Figures 1A, 1B, 1C, 1D, 2, 3, 4, 5A, 5B, 5C:
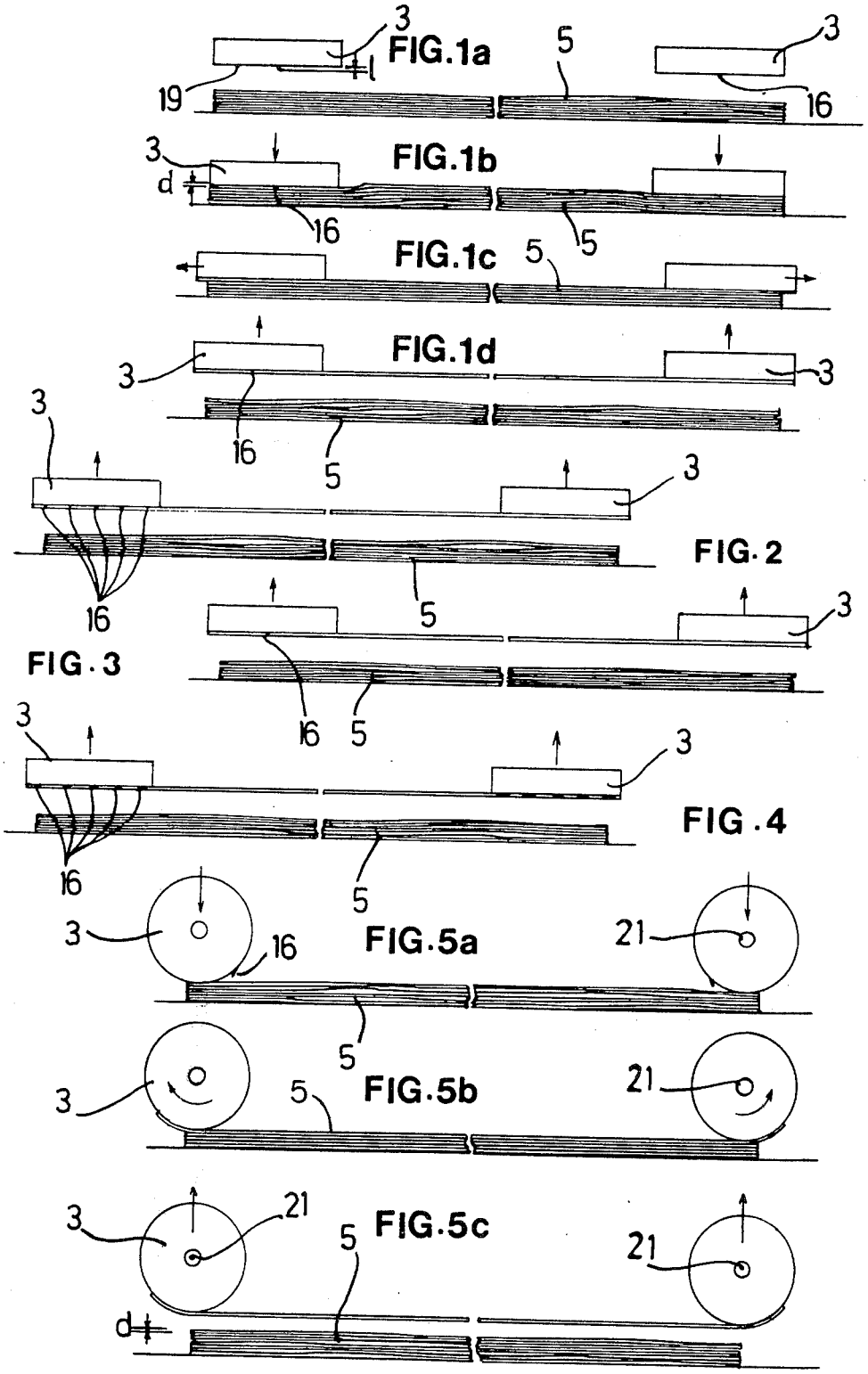

As is shown in an enlarged scale in FIGS. 1*a* to 1*d*, a stack of sheets 5 has, after being cut, a thickness which exceeds the product of the number of sheets of which it is composed multiplied by the thickness *d* of each sheet, owing to the fact that the sheets are not fully flat so that there is air between them. According to the process of the invention, pressure will vertically be applied at the opposite edges of the stack 5 by means of the elements 3 to substantially flatten at least the sheet or sheets to be removed as shown in FIG. 1*b*. Preferably, the pressing of the elements 3 aims at compressing the sheets of which the stack is composed to such an extent that at least the upperside of the next lower sheet, considered as from above, is located at a distance from the underside 19 of the elements which is equal to the thickness *d* of the upper sheet. Practically, this will result in the stack 5 being compressed to a total thickness which is equal to the product of the number of sheets present in it multiplied by the thickness *d* of one sheet. Thus compressing the stack results in the projections 16 penetrating the upper layer without affecting the next lower one.

Next, as is shown in FIG. 1*c*, the separating elements 3 are moved horizontally in opposite directions so as to produce a shifting of the upper sheet with respect to the underlying sheet, so that the hitching or the tendency to hitch between these sheets is eliminated. Said shifting is obtained by tightening the upper sheet or, in case of an elastic material, stretching it slightly.

Obviously, as shown in FIG. 1*d*, the upper sheet thus picked up will be lifted up when the separating elements are raised vertically, while the underlying sheet remains on the stack. The removed sheet can now be placed on any suitable place for further processing.

The process according to the invention can also be applied to simultaneously picking up more than one sheet. When the number of sheets to be removed simultaneously is equal to *n*, the insertion length *l* of the needles 16 is between $n \times d$ and $(n - 1) \times d$. The $(n + 1)$th sheet from the top then remains as the upper sheet on the stack.

FIG. 2 shows a beam-shaped separating element 3, whose underside is provided with several needles or rows of needles with the same insertion length, whereas FIG. 3 shows an embodiment using needles or pins 16 extending at an oblique angle to the outside. The vertical height *l* of each needle 16, i.e. the distance from the free end of such a needle or pin to the underside 19 of the separating element on which it is attached, is in this case also less than the thickness $(n \times d)$ of the number of sheets $(n)$ to be picked up, but greater than $(n - 1) \times d$. In this case the above described process of FIG. 1 is also employed but, preferably during the compression, the separating element will at the same time be slightly moved to the outside in order to facilitate the penetration of the oblique needles. Analogous to the embodiment in FIG. 2, several oblique needles or rows of oblique needles can be used, as shown in FIG. 4.

FIG. 5 shows a separating element whereby the needles 16 are attached to the underside of a cylindrical or disc-shaped separating element which is pivotable about a drivable horizontally arranged shaft 21. Also in this case, the stack of sheets will be compressed vertically to the desired thickness (FIG. 5*a*) and, simultaneously, the separating elements 3 will be pivoted through a small angle about the shaft 21 (see direction of arrow) in order to pick up the desired number of sheets. Further rotation of the separating elements in the same direction results in a stretching or tightening of the sheet or sheets (FIG. 5*b*). Depending upon the degree of hitching with the next lower sheet, the pressure on the picked up sheet can be slightly reduced during this further rotation. The picked up and stretched sheet is finally lifted in the usual manner (FIG. 5*c*).

Figure 6:
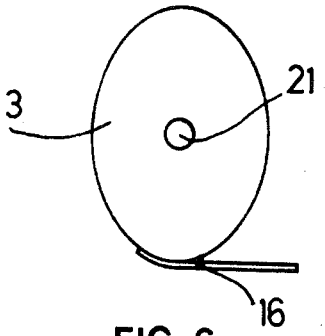
Figure 7:
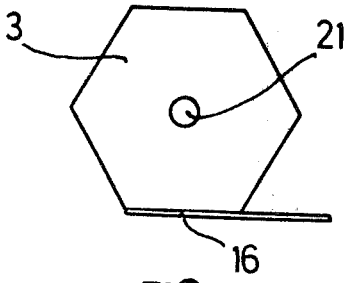
Figure 8:
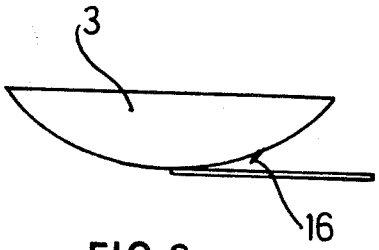

Possible shapes of separating elements 3 functioning according to rotation principle are shown in FIG. 6: an oval separating element; FIG. 7: a polygonal separating element; and FIG. 8: a segmental separating element. Obviously, still other shapes are conceivable.

Figure 9A:
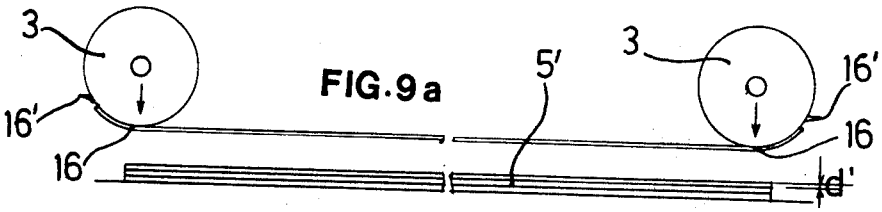
Figure 9B:
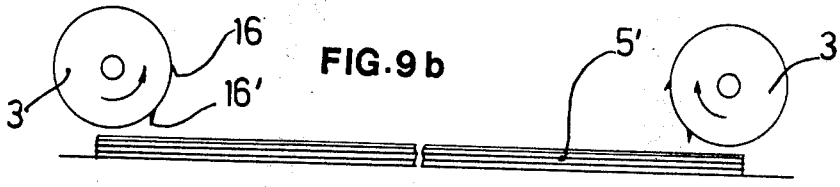
Figure 9C:
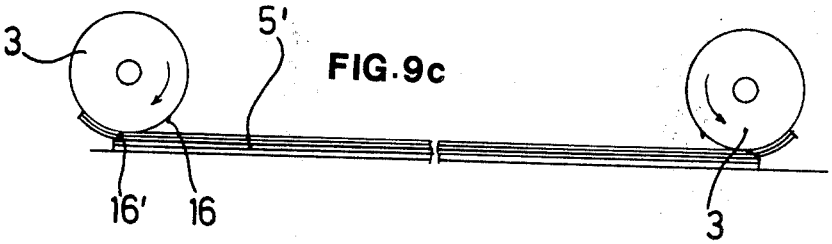

It is also possible to remove sheets from several stacks with the same device. One of the various application possibilities is illustrated in FIGS. 9*a* to 9*c*. Here the separating elements are provided with projections 16 respectively 16′, the latter having a larger insertion length than the former. The separating elements 3 shown in FIG. 9*a* carry a sheet, with thickness *d*, picked up and tightened by means of needles 16 having an appropriate insertion length *l*, and removed from a preceding stack. The arrows suggest that these sheets are deposited upon a second stack 5′, in which stack the sheets have a thickness *d*′. When the discs are turned back (direction of arrow in FIG. 9*b*), the pricked layer is released and detached from the pins 16, so that it remains on top of stack 5′. Successively, the upper sheet, together with one or more of the sheets with thickness *d*′ is picked up from stack 5′ by the needle projections 16′ having an appropriate insertion length according to the process described hereabove: compressing, picking up, tightening and lifting.

Although in the described embodiments there is always talk of a needle or pin, it is clear that regularly spaced needles or pins 5 can also be used. This means that for example the separating elements 3 will be given a length which is equal to the dimensions of the sheets to be picked up at the spot of such separating element, whereby in such case one or more needles are provided under the separating element so as to improve the seizure of the material.

Similarly, it is clear that other projections can be very advantageously substituted for such needles or pins. By "projections" must be understood both projections in the real sense of the word and burr-shaped portions on a plate whereby said burr-shaped projecting parts of such a plate function as needles or hooks.

A variant embodiment is illustrated in schematic drawings 10*a* to 10*e*, whereby the compressing and picking up of the separating elements are controlled separately. Said figures show the five most important steps of the process according to the invention. As appears from FIG. 10*a*, the cubic or beam-shaped separating elements 3 are again placed in the vicinity of two opposite upper edges of a stack of supple sheets 5, whereby they are now provided with at least one appropriate bore 3′ in which is positioned a needle 16 or a pin capable of a sliding movement along its axis. The bore is preferably obliquely oriented in such a way that the downwardly directed points of the needles in the bore extend obliquely to the outside.

The separating elements 3 are applied on the stack with the needles in retracted position so that the stack is pressed flat in the vicinity of its opposite edges, as is shown in FIG. 10*b*. Next, the needles 16 in bores 3′ are moved out and downwards over a projecting length $$s = \frac{d}{\sin \alpha},$$

where $d$ is the thickness of the sheet and $\alpha$ the angle of the needle with respect to the horizontal. This stage is shown in FIG. 10*c*. If $n$ sheets with thickness $d$ are to be picked up, then the following relation holds for the projecting length $s$:

$$\frac{(n-1)\,d}{\sin \alpha} < s < \frac{n\,d}{\sin \alpha}$$

The further operations such as tightening or stretching by slightly moving the opposite separating elements horizontally apart (FIG. 10*d*) and lifting the pricked and detached sheet (FIG. 10*e*) are identical to those of the preceding embodiments. An advantage of this device with obliquely slidable needles over the device shown in FIG. 3 with fixed oblique projections is that the slight movement to the outside of the separating elements during compressing to obtain locally efficient picking up can now be eliminated. This considerably simplifies the compressing operation.

It is evident that a plurality of needles and/or needle rows can be used, as well as cylindrical or disc-shaped (FIG. 11), polygonal, segmental, etc. separating elements.

An important advantage of separating elements with slidable needles is that they are of a more universal nature and applicable to different sheet thicknesses depending upon the free projecting length of the needle ends. FIGS. 12 and 13 are schematic views of separating elements with systems for adjusting the projecting length of the needles. A segmental rotatable separating element 3 comprises, according to FIG. 12, an appropriate excentric bore 3′ in which the needle 16 is mounted, whereby said needle can slide upwardly and downwardly according to an adjustable projecting length. Therefore the needle is clamped in a plate 18 which can be screwed upwards and downwards by means of an adapted adjusting screw which is connected to the segment 3. The adjusting screw may also make direct contact with a needle having adapted screw threads near its end away from the needle point, without use of the clamp plate 18.

FIG. 13 shows still another embodiment of the invention whereby use is made of flexible needles 16 with adjustable projecting length and whose upper end is clamped in a plate 18, of which the position can be regulated by means of adjusting screws 37 as described hereabove. The oblique bores 3′ in the separating elements 3 are slightly larger than the needle diameter. Upon pressing the clamping plate 18 with the needles downwards onto the required level, the needle points in the guiding bore 3′ will bend and penetrate obliquely into the sheet to be removed. This embodiment offers the advantage that pressing upon the separating elements 3 and upon the needles for picking up can be accomplished vertically.

In all separating elements with flat undersides 19, the needles can evidently be disposed in straight or curved rows, depending upon the contour of the sheets to be picked up. The use of clamp plates in separating elements with flat undersides offers the advantage that, depending upon the form of the sheets, only those needles must be projected which follow most closely the contour of the sheets, or they can all be projected whereby care is taken that some needles project outside the contour of the sheets so that at least some needles always reach the contour of the sheets.

It is also possible to provide the needles with different projecting lengths when sheets with different dimensions are to be removed from different stacks, depending upon the shape of different sheets, whereby, however, first only a small sheet and successively a larger one, etc. can be removed.

Figure 14:
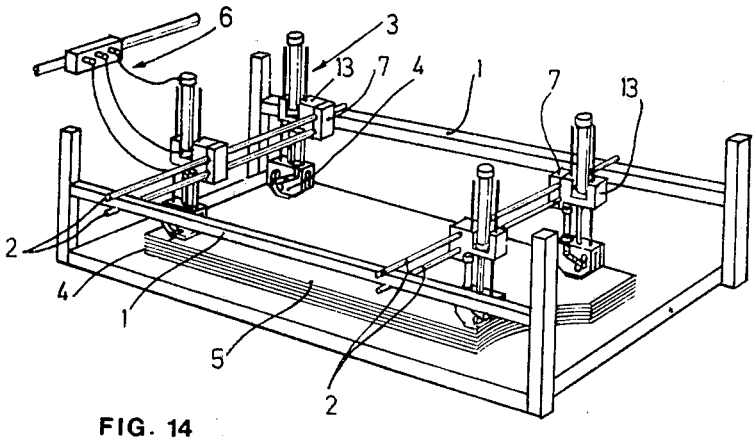
FIG. 14 is a perspective view of a universal separating apparatus wherein another universal separating element is used.

FIG. 14 is a perspective view of a separating apparatus in which another separating element is used. The separating element and its operation are further described with reference to the remaining drawings.

By means of the separating elements, sheet by sheet can be picked up from a stack 5 of size cut textile sheets which lay in the same direction, said stack being located on a separating table. Therefore solid horizontal girders 1 extend over the table. These girders are mutually cross-connected by means of rods 2, which rods are adjustably attached to the girders, e.g. by means of nuts and bolts. Next, the proper separating elements 3 are also adjustably attached to said cross-rods 2 by means of solid grips 7. The places of attachment of the cross-rods and separating elements are selected in such a manner that the pickup heads 4 of the latter are located above the corners and/or edges of the stack of textiles to be removed, as schematically shown in FIG. 14. The separating elements are electrically or pneumatically controlled in a synchronic way to ensure a uniform separating operation. This is being suggested by means of supply hoses 6, e.g. for compressed air.

Figure 15:
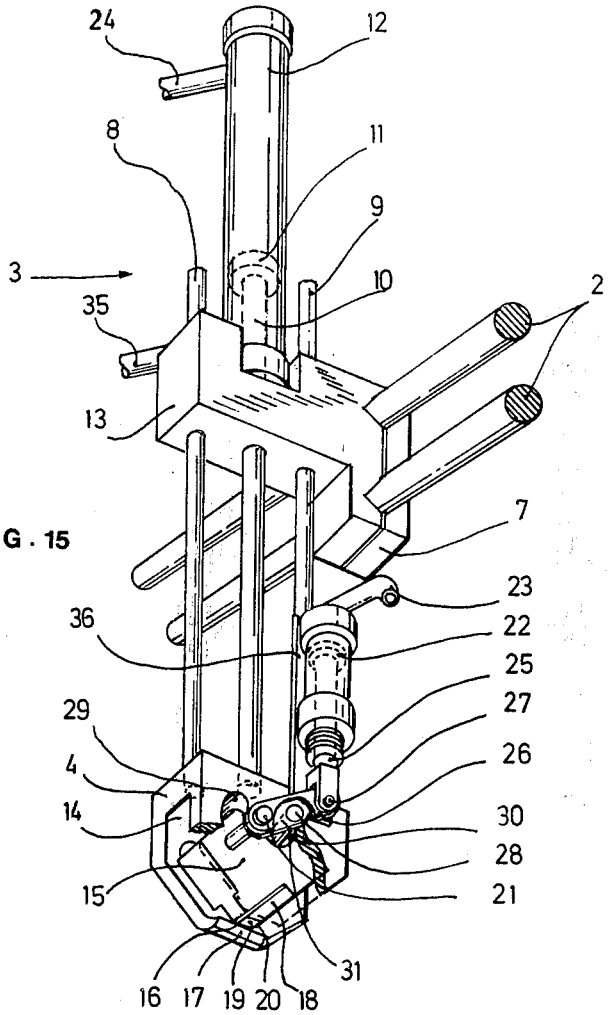
FIG. 15 is a perspective view of an embodiment of the universal separating element shown in FIG. 14.

An embodiment of the universal separating element 3 with pick-up head 4 is shown in greater detail in FIG. 15. For the sake of clarity, for the following description, reference is made to the detailed drawings 16*a*, 16*b* and 16*c*.

The entire separating element 3 is in fact supported by a bearing 13, for example cast in aluminium, which is adjustably attached to cross-rods 2 by means of grips 7. This bearing is provided with three vertical bores through which the guiding rods 8 and 9 and a compression bar 10 can be slid upwardly and downwardly. The compression bar 10 is connected to, for example, a piston head 11 in the pressure cylinder 12. To apply a downward pressure, for example, an adapted pneumatic impulse is exerted via supply pipe 24, whereas for the lifting movement a similar impulse via supply pipe 35 at the bottom of the cylinder 12 is applied.

The pick-up head 4 is U-shaped with a downward recess 14 which is bordered by pressure shoes 17. One of the pressure shoes is partially cut away to make the pricking element 15 with the needles 16 visible. These needles with adjustable projecting length are attached to the pricking element by means of a suitable clamping plate 18 (FIG. 19). The underside 19 of this clamping plate is leveled off in such a manner that, in pricking position, the plane 19 has a definite inclination with respect to the horizontal, whereby the edge of the plane 19 against the needles is lower than the free edge 20 thereof. The object thereof is that at the spot of the pricking needles, the pressure contact is as much as possible reduced to a line contact. The number of needles — preferably disposed in a row — may vary from one to five per pricking element.

The needles used are the generally used industrial textile needles with sharp, medium-blunt or flattened points according to the nature of the material to be removed. The underedge of the pricking element, which is in contact with the needles at their direction of tightening does not extend as low as the underside of the clamping plate 18 (see FIG. 19). The result thereof is that scouring or sliding of the needle points over the material is more effectively avoided than when beam-shaped separating elements are used.

The pricking element 15 is fixedly connected to a shaft 21. This shaft 21 extends at both sides through slots 29 into the pressure shoes, and is at one end fixedly connected to a lever arm 26, see FIG. 18. At its other end 27 the lever arm is hingedly connected to the bottom end of the piston rod 25 which is also capable of an upward and downward movement in the pressure cylinder 22, which is provided with a suitable pressure pipe 23. The cylinder 22 is attached to the pick-up head via a plate 36. A second shaft 28, parallel to shaft 21, is rotatably located in the pressure shoes and rotatably connected around shaft 21 by means of fixed and parallel connecting arms 31 at both sides of the pick-up head (FIG. 18). The shaft 28 extends through a cylindrical slot bore 30 into the pricking element. The rotation of the shaft 28 in its bearings in the pressure shoes is generated by adequate pressure forces, respectively pulling forces, acting on the connecting arm ends shown in FIG. 18.

The operation of the full arrangement will now be described with reference to FIGS. 16*a*, 16*b* and 16*c*. In a first stage (FIG. 16*a*), the pick-up heads are moved downwards by means of a pressure impulse via supply hoses 24 and pressed upon the stack of sheets, near the edges or corners thereof. Successively, the retracted pricking element is forced to rotate downwards around its axis of rotation 21 via lever 26 by exerting a pressure impulse through supply pipe 23 in the cylinder 22, which impulse pushes down the piston rod 25 and the lever 26 hingedly connected thereto in 27. This pivoting movement continues until the needle points 16 prick into the upper sheet through an angle of 25 to 70°, preferably 45°. The pricking direction preferably coincides with the direction of the needle axis. In this pricking position, the needle points are approximately in the plane of the under edges of the pick-up head and preferably extend even a little further.

The pressure of the pick-up heads 4 on the stack is successively slightly reduced, and the pricking elements are forced to continue to rotate in the same sense, due to the pressure in cylinder 22, however in this case about the axis of rotation 28; this second rotating movement is shown in FIG. 16*b* and results in a substantially horizontal stretching of the pricked layer, since two opposite and synchronically functioning separating elements always produce an opposite moving direction of the pricked sheet edges. It is precisely this combination of oblique picking up and horizontal tightening which is characteristic of the invention, as it results in the most reliable separating action and as it efficiently counteracts damage of the sheet edges owing to scouring of fibers and such like. Indeed, if for picking up and tightening the same circular movement of the needle points would be applied, there is a considerable danger that the needle points would slide or scour over the sheet without efficient picking up, or even worse, with damaging the sheet locally by tearing or unraveling. To provide an identical and predetermined tightening distance at both opposite edges of the stack, it is possible as a matter of course to have the pricking element stopped by contact against a suitable stop (not shown) transversely arranged in the pick up heads.

An additional important advantage of the present separating element over beam-shaped separating elements is that apart from the sheet edges being pressed flat by the pressure shoes of the pick-up head, an additional pressure action, limited to nearly a pressure line, is exerted by the pricking element itself. By the combination of a suitable needle projecting length, together with this remaining line pressure of the pricking element during picking up (while the pressure of the pressure shoes is more or less released), a fully controllable and fool-proof pricking operation is obtained. Any possible hitchings by the thus picked up and stretched or tightened sheet to the next lower sheet are thereby eliminated. In other words, the underlying sheet remains undisturbed on the stack and the picked-up sheet (or sheets) can now be lifted by means of the pick-up head 4 by exerting synchronic pressure impulses in the supply hose 35 of the cylinder 12, as shown in FIG. 16*c*.

The successive rotating movements of the pricking element are shown in greater detail in FIGS. 17 and 18. The pricking element is normally kept in its retracted position by the action of an adequate built-in (and not shown) spring in the cylinder 22. This spring lifts lever arm 26 in hinge 27 together with the pricking element to its extreme upward position.

The pick-up is accomplished by the fact that the pressure in the cylinder 22 pushes down the piston rod 25 and the lever 26 in link 27 against the action of the spring in cylinder 22. This results in a rotation of lever 26 around shaft 21, and of shaft 21 around its own axis and of the pricking element fixedly attached thereto. This rotation continues until the stop 33 (FIG. 18), which is crosswisely anchored in levers 26, comes into contact with the connecting arm end 34.

The angular orientation of the pricking element on shaft 21 is adjustable (therefore a wide slot bore 30 is provided in the pricking element) and is so regulated that when the stop 33 comes into contact with the arm end 34, the pricking points have descended into their pricking positions, i.e. into the plane of the underside of the pressure shoes, and preferably somewhat lower, so that the efficiency of the earlier mentioned line pressure is adequately used. The contact of stop 33 with arm end 34 results in the fact that when further pressure is applied by the cylinder rod 25 on the lever arm 26, the latter, together with the connecting arm 31 (and against the pulling action of the spring 32 in the arm end 34), and together with shaft 21 and the pricking element, starts to rotate around shaft 28. The center of rotation of the pricking element during the pickup operation, namely shaft 21, has thus been transferred to shaft 28, which results in an almost total horizontal travel for the needle points.

When releasing the picked-up layer, the mentioned operations evidently take place in the opposite order. The pressure in cylinder 22 is released and the spring 32 pulls the connecting arms 31 in the end 34 upwardly while the spring in cylinder 22 further lifts the lever 26 in hinge 27 together with the pick-up element. The pressure shoes at both sides of the pick-up element substantially facilitate the release of the needles from the layer when the pick-up element is again retracted. This is an additional advantage of the pick-up element according to the invention.

If the layers to be removed show a mutually differing surface roughness, then it is to be preferred to put the sheets with the smoothest surfaces at the top of the stack and to put the sheets with a rougher surface progressively towards the bottom. In this manner, it is effectively avoided that the separation resistance between each successive pair of upper sheets (after removing the foregoing sheet) would be greater than the separation resistance between the underlying sheets of the stack.

Because of the adjustability of the projecting length of the needles and the choice of the needle point shapes, the separating element can be adapted to a great variety of sheets with different structures, textures, thicknesses, elasticity, stiffness, weights, etc. Evidently, if desired it is also possible to remove two or more sheets at the same time. If $s$ is the projecting length of the needles according to the direction of their axis and measured from their point of contact with the leveled underedge of the clamping plate, and if $\alpha$ is the pick-up angle and $d$ the thickness of the pressed flat sheet to be picked up, then $s$ is preferably equal to $d/\sin \alpha$. Furthermore, the maximum reliability in operation of the separating elements make them suitable for application in partially or fully automatic processing chains for sheets, e.g. for the supply of automatic stitching machines.

Another aspect of the universal nature of the separating elements in that the pricking pressure and tightening tension (cylinder 22) are adjustable separately from the pressure shoe load (cylinder 12).

In ready-made clothes workshops, one or more separating apparatus according to the invention can be installed over an intermittently progressing conveyor belt on which several stacks can be formed sheet by sheet and/or removed by applying the adapted separating movement and/or disposing movement at the successive stops of the conveyor belt.

The invention is evidently not restricted to the proposed and described embodiments which must be considered as only examplary illustrations of the invention. Constructive modifications to the attachment and up-and-down movement construction, of the separating elements, as well as the shape of the pick-up head, of the recession and of the pricking element fall within the framework of the present invention.

What is claimed is:

1. A process for separating one or more supple sheets from a stack comprising:

compacting the stack at least in the vicinity of its opposite lateral upper edges, providing at least one sharp projection at each of said opposite lateral upper edges, the projections at one of said edges being opposite the projections at the other of said edges, subsequently to the step of compacting the stack, introducing sharp projections obliquely in the sheet or sheets near said edges in order to engage the sheet or sheets to be removed, said projections being pointed outwardly toward their respective said edges, slightly releasing the pressure on the stack, moving said opposite projections apart in opposite directions in order to tighten the sheet or sheets to be removed, and finally lifting from the stack the thus engaged and tightened sheet or sheets.

2. The process according to claim 1 wherein an additional linear pressure is applied in the immediate vicinity of the projections simultaneously with the introducing thereof into the sheets.

3. Apparatus for separating one or more supple sheets from a stack comprising:

a supporting framework, at least one pair of separating elements positioned opposite each other, each of said elements being adjustably attached to said framework by means of a bearing, said bearing having a vertical bore, each said element including a guiding rod slideably received in said bore and means connected to the upper end of said rod for raising and lowering same, a downwardly opening U-shaped pickup head connected to the lower end of each of said rods, said heads each having a pair of downwardly extending legs forming a recess therebetween, a pricking element, having sharp projections on its underside, being connected to each of said pickup heads and positioned within its said recess, each said pricking element being pivotable from a recessed position to a working position about at least one horizontal pivot perpendicular to the legs of its said pickup head, means for extending said pricking elements from their recessed positions to their working positions wherein at least a portion of the movement of said pricking element undersides is substantially in the plane of the said underside of their respective said pickup heads and wherein the direction of movement of the sharp projections of one of said opposite separating elements is opposite the direction of movement of the sharp projections of the other of said opposite separating elements during said portion of the movement of said pricking element undersides.

4. The apparatus of claim 3 and wherein said sharp projections are downwardly extending needles which are adjustably secured to said pricking element underside for variable projecting lengths.

5. The apparatus of claim 4 and wherein said means for extending said pricking elements includes means for extending said needles substantially linearly through an angle of 25–70° relative to the horizontal portion of said movement of said pricking element undersides.

6. The apparatus of claim 5 and wherein said angle is 45°.

7. The apparatus of claim 4 and wherein each of said pricking elements includes clamping means for securing said needles in place, said clamping means extending below the underside of said pricking element and said needles extending below said clamping means.

8. The apparatus of claim 3 and including means for synchronically controlling the vertical movements of said separating elements and the movements of said pricking elements.

9. Apparatus for separating one or more supple sheets from a stack comprising:

a supporting framework, at least one pair of separating elements positioned opposite each other, each of said elements being adjustably attached to said framework by means of a bearing, said bearing having a vertical bore, each said element including a guiding rod slideably received in said bore and means connected to the upper end of said rod for raising and lowering same, a downwardly opening U-shaped pickup head connected to the lower end of said rods, said heads each having a pair of downwardly extending legs forming a recess therebetween, a pricking element, having sharp projections on its underside, being connected to each of said pickup heads and positioned within its said recess, each said pricking element being pivotable from a recessed position to a pricking position about a first horizontal pivot and pivotable to a tightening position about a second horizontal pivot, and means for first rotating each aid pricking element about its said first pivot and subsequently about its said second pivot wherein during the rotation about its said second pivot, said pricking element underside is constrained to move substantially in the horizontal plane of the underside of its said pickup head, said opposite separating elements being oriented in opposite horizontal directions.

* * * * *